US007247779B2

(12) United States Patent
Zumsteg

(10) Patent No.: US 7,247,779 B2
(45) Date of Patent: Jul. 24, 2007

(54) PITCH CHANGING ARRANGEMENTS FOR PEDAL STEEL GUITAR

(76) Inventor: D. Bruce Zumsteg, 25625 S. Brush College Rd., Harrisonville, MO (US) 64701

( * ) Notice: Subject to any disclaimer, the term of this patent is extended or adjusted under 35 U.S.C. 154(b) by 171 days.

(21) Appl. No.: 11/063,466

(22) Filed: Feb. 23, 2005

(65) Prior Publication Data

US 2006/0185494 A1 Aug. 24, 2006

(51) Int. Cl.
*G10D 3/14* (2006.01)

(52) U.S. Cl. ..... 84/312 P; 84/312 R

(58) Field of Classification Search ..... 84/312 P, 84/312 R

See application file for complete search history.

(56) References Cited

U.S. PATENT DOCUMENTS 3,014,395 A * 12/1961 Blair ..... 84/312 P
4,080,864 A * 3/1978 Jackson ..... 84/312 P
4,157,050 A * 6/1979 Lashley ..... 84/312 P
5,092,214 A * 3/1992 Flynn ..... 84/312 P
6,002,075 A * 12/1999 Carter ..... 84/312 P
2006/0185494 A1* 8/2006 Zumsteg ..... 84/312 P

* cited by examiner

*Primary Examiner*—Lincoln Donovan
*Assistant Examiner*—Robert W. Horn
(74) *Attorney, Agent, or Firm*—Erickson & Kleypas, L.L.C.

(57) ABSTRACT

The invention as described herein consists of a pitch-changing arrangement as may be used in a pedal steel guitar to improve the quality of the sounds emanating therefrom. The invention incorporates a tone ring for transferring the string energy from the neutral position raising lever directly into the guitar cabinet. The invention also allows for the pitch-changing device to be stopped in the raised position by the guitar cabinet slot thus imparting the string energy directly into the guitar cabinet.

21 Claims, 5 Drawing Sheets

PITCH CHANGING ARRANGEMENTS FOR PEDAL STEEL GUITAR

BACKGROUND AND OBJECTIVES OF THE INVENTION

1. Field of the Invention

This invention relates generally to pedal steel guitars and more particularly to a pitch-changing arrangement which improves the tonal quality of the sounds generated by said pedal steel guitar.

2. Description of the Prior Art

The pedal steel guitar is a lute-type instrument which normally comprises one or two necks, each neck having from eight to fourteen strings. A pedal or lever-actuated pitch-changer is generally provided which allows the pitch of selected strings to be raised or lowered in order to expand the number of musical chords available to the player. In this regard, the strings of the pedal steel guitar are normally tuned to a standard tuning wherein the tension on each string is adjusted to produce a selected pitch. Pitch-changing devices allow the tension on selected strings or groups of strings to be selectively increased or decreased, thereby selectively altering the pitch of the strings. For example, a typical pedal steel guitar is shown and described in U.S. Pat. No. 5,092,214, herein incorporated by reference. A typical all-pull pitch-changing device of the prior art is shown and described in U.S. Pat. No. 6,002,075, herein incorporated by reference.

Nowadays the prior art design which is considered the "benchmark" for tonal quality in pedal steel guitars is commonly known as the "Emmons" guitar, such as shown by U.S. Pat. No. 3,447,413, commonly invented by Lashley and Emmons. The mechanism of this guitar has also been given a popularly-used name, i.e., it is commonly referred to in the industry as a "push-pull" mechanism. The design featuring this push-pull mechanism was likely designed around the prevalent technology circa the time of the invention (i.e., 1965). That is, among other things, the design featuring this push-pull mechanism uses the guitar cabinet slot as the forward mechanical stop for the raising pitch-changing levers. In any event, the resultant tone of this instrument was far superior to anything else before, and possibly anything else to date subsequent to its design. Technically speaking, this "push-pull" mechanism is inferior to most any "all-pull" mechanism of today. It is believed by the inventor hereof (who has been in the business of designing and manufacturing pedal steel guitars for twenty-nine years) that no one has ever used the cabinet slot of the guitar body as a forward stop for the raised pitch of the string (such as used in the "Emmons" patent reference of U.S. Pat. No. 3,447,413) within the design environment of an "all-pull" mechanism. The patent reference of Carter, U.S. Pat. No. 6,002,075 can be distinguished in this respect because it stops the raise lever in the neutral position.

To a large degree, the tonal quality of pedal steel guitars is determined by the transmission of the string energy through the guitar. This includes transmission of energy through the various components of the guitar including the end plates, pitch-changer, levers, keyheads, return stops, etc., but primarily and foremost, through the guitar cabinet soundboard itself. The guitar cabinet soundboard may be defined as that section of guitar cabinet top that lies between the pitch-changing bridge and the tuning keyhead assembly at the opposite end of the guitar top. Therefore, it is an object of this invention to improve the tonal qualities of a pedal steel guitar by means of a pitch-changing arrangement and/or mounting design which distinctively transfers the string energy into the guitar cabinet soundboard of the pedal steel guitar by an improved way over the prior art.

An existing problem in today's typical all-pull pedal steel guitar is the effect of temperature on the tuning of the raised pitch-changers. Since the raise lever is actuated by a metallic pull rod being of a possible overall length of approximately thirty inches, a change in ambient room temperature can cause this pull rod to expand or contract, thus affecting the raised pitch of the string. It will become apparent that the present invention eliminates this problem by its inherent design.

A number of additional features and objects will be apparent in connection with the following discussion of preferred embodiments and examples.

BRIEF SUMMARY OF THE INVENTION

A primary advantage of the present invention is to improve the tonal qualities of a pedal steel guitar. This is accomplished by providing a tone ring/neutral stop bar which is mounted in direct contact to the guitar cabinet soundboard and which provides rigid contact with the raising lever in the neutral position.

Another advantage of the present invention is to provide a pitch-changing arrangement that directs the string energy more directly into the cabinet soundboard of a pedal steel guitar. This is accomplished by providing a raising lever which utilizes the cabinet slot as its forward mechanical stop thus imparting the string energy directly into the guitar cabinet soundboard.

Another advantage of the present invention is to provide a pitch-changing arrangement in which the raised pitch is not affected by a change in ambient temperature. This is accomplished by providing a raising lever which uses the cabinet slot as its forward mechanical stop, thus eliminating the effect of temperature change on the actuating pull rod and hence the raised pitch of the string.

The present invention consists of a pitch-changing mechanism which is comprised of three basic parts. A tension control lever, to which the guitar string is attached, is connected pivotally to a bridge pin. A raising lever is also connected pivotally to said bridge pin and is placed adjacent to the tension control lever. A lowering lever is connected pivotally to the raising lever and has an upper cam which is in pivotal contact with the tension control lever, and a return spring at the opposite end which holds the lower lever in contact with a stop plate in the neutral position. Both the raising and lowering levers are respectively fitted with a flange for selectable connection to a pull rod. Each pull rod can be selectively actuated by a pedal or lever otherwise mounted on the guitar as defined by prior art. When the raising lever is actuated by said pull rod, the tension control lever is rotated in a clockwise direction, thus increasing the tension on the string. Conversely, when the lowering lever is actuated by a pull rod, the tension control lever is rotated in a counter-clockwise direction, thus decreasing the tension on the string.

BRIEF DESCRIPTION OF THE SEVERAL VIEWS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

What differentiates this all-pull pitch changing arrangement from all others of the prior art is the method in which the raised pitch is stopped and subsequently tuned in the present invention. In this arrangement, the initial string tension is adjusted by the tuning key when the string pitch is in the raised position, i.e., the raising lever is actuated by a pull rod and is stopped against the guitar cabinet slot. The actuating pedal or lever is then released, allowing the string pitch to return to the neutral position. The neutral, or "open" pitch, is then tuned with an adjustment screw that is incorporated within the neutral stop bar of the tone ring. When the string pitch is decreased by actuating the lowering lever with yet another pull rod, the raising lever remains in contact with the neutral stop bar adjustment screw incorporated in the tone ring. Thus, in all positions of tuning, i.e., raised, neutral, or lowered, the string energy is imparted directly into the guitar cabinet soundboard. The present invention may be distinguished from Carter U.S. Pat. No. 6,002,075, herein incorporated by reference, in that in the preferred embodiment all string energy is directed into the soundboard side of the cabinet slot, from all positions, i.e., neutral, raised or lowered; whereas in the Carter Patent string energy is directed into only a small portion of cabinet material on the non-soundboard side of the mechanism, and even then, only from the neutral and lowered positions of the mechanism. Since it is common to play the majority of sounds of this instrument with many of the strings in the raised pitch position, the present invention provides a very significant improvement over other all- pull pitch-changing arrangements of the prior art. Also, as evident from this description and from the drawings, the distance between the tuning stops from the neutral position to the raised position are in the range of fractions of one inch, as opposed to as much as thirty inches on a conventional all-pull guitar, thus greatly reducing the tuning discrepancies due to room temperature fluctuations.

Detailed description of the preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
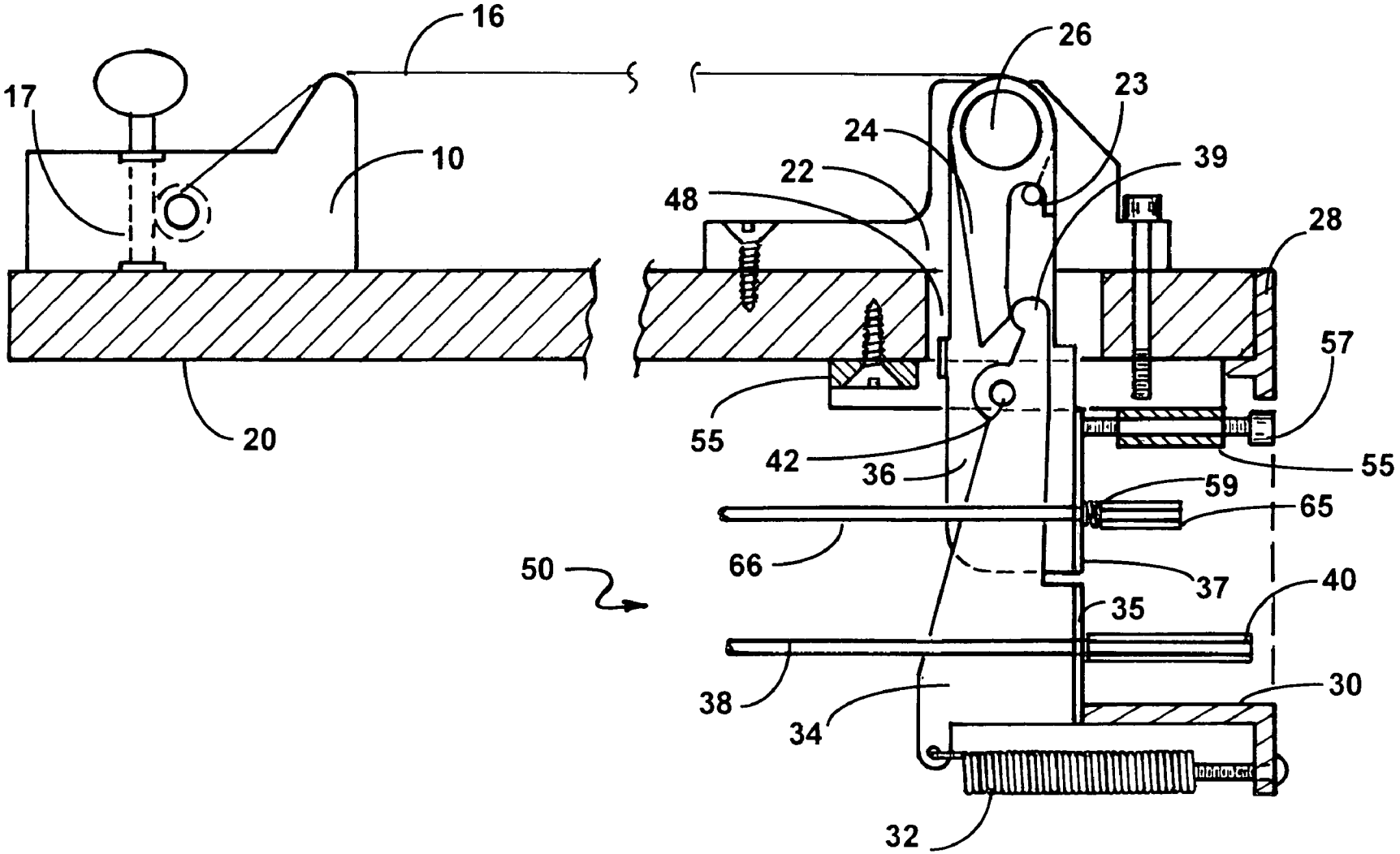
FIG. 1 is a side view of the pitch-changing device in accordance with an embodiment of the invention in the neutral position showing the guitar string connected to the keyhead of the pedal steel guitar.

Referring to FIG. 1, the reference numeral 50 generally designates the pitch-changing device in the neutral position showing the guitar string connected to the keyhead of the pedal steel guitar embodying features of the present invention. Pedal steel guitar 50 includes a guitar cabinet soundboard 20 which has at one end a keyhead assembly 10 to which tuning keys 17 are attached for adjustably securing one end of each of a plurality of strings 16. Strings 16 are stretched above a fretboard 19, not shown but well known in the art. The opposite end of each string 16 is attached to a tension control lever 24 by a string attachment means 23. In the preferred embodiment of the invention, a tone ring 55 completely encircles a plurality of pitch-changing levers 50 and incorporates the neutral stop adjustment screw 57 which is in direct contact with the raising levers 36 when in the neutral or non-actuated position. Said tone ring 55 is mounted in direct contact with the guitar cabinet soundboard 20 so as to transmit the string energy directly into the guitar cabinet soundboard 20. Also in the preferred embodiment, the raising lever 36 is constructed so as to stop against the guitar cabinet slot 48 when the raising lever 36 is actuated to the raised pitch position, thus imparting the string energy of the raised pitch directly into the guitar cabinet soundboard 20.

Figure 2:
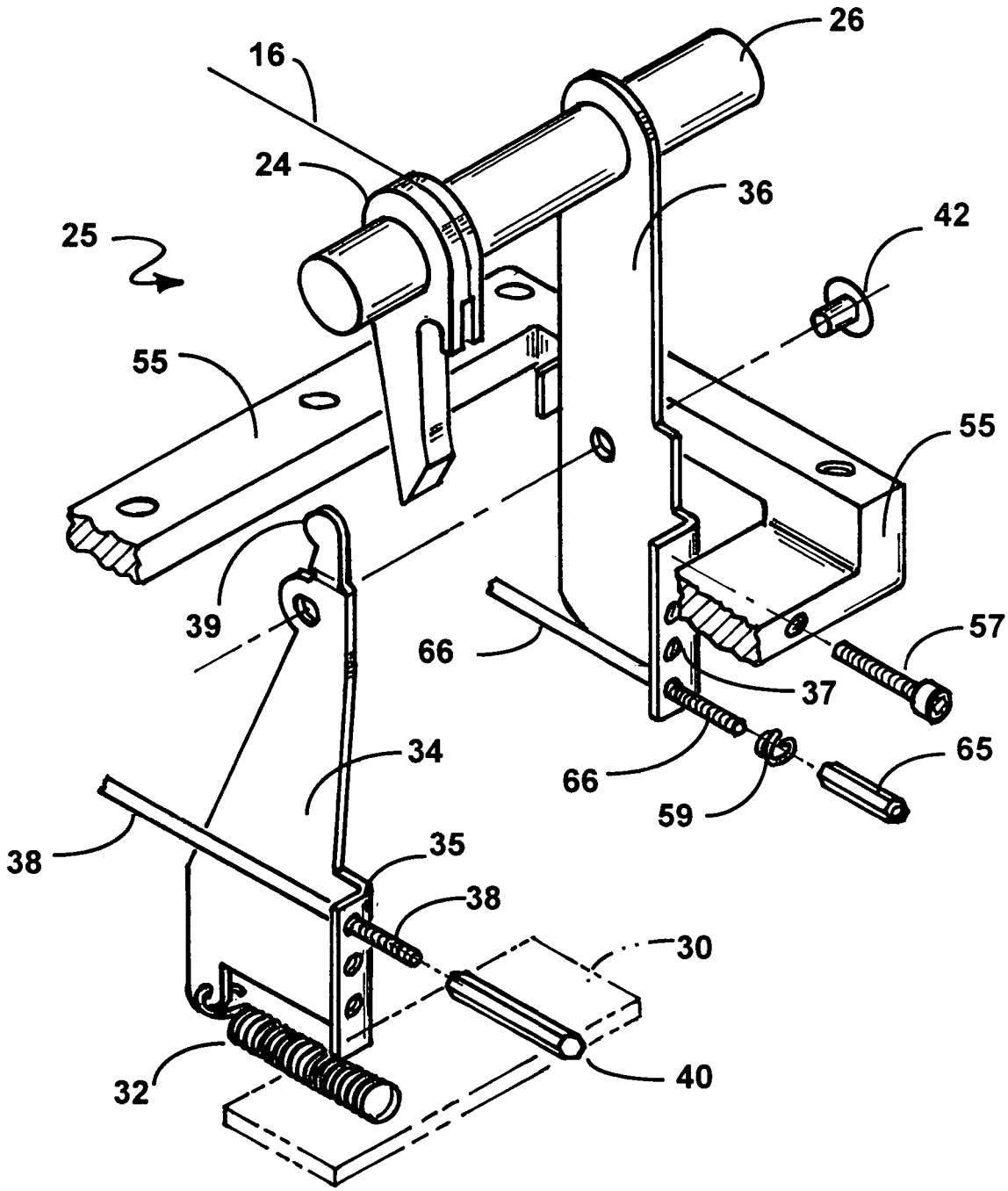
FIG. 2 is an isometric assembly drawing of the pitch-changing device in accordance with an embodiment of the invention, showing the three levers: a tension control lever; a raising lever; and a lowering lever. Also shown is a tone ring encircling the pitch-changing device.
Figure 4:
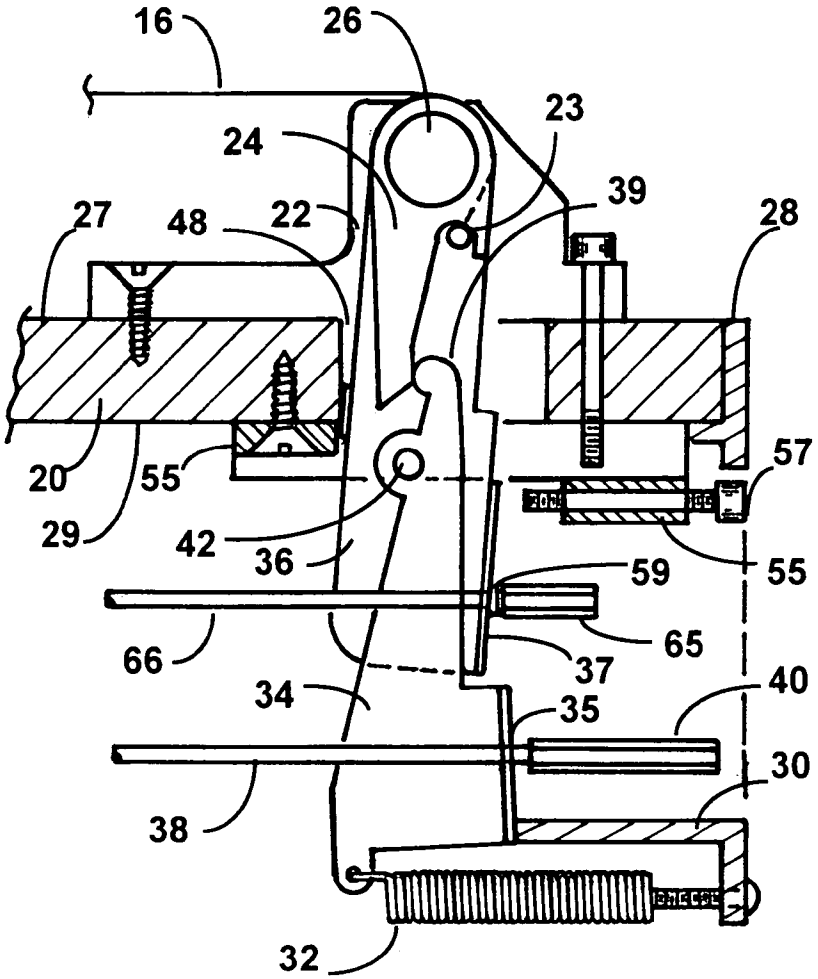
FIG. 4 is a side view of the pitch-changing device in the raised position in accordance with an embodiment of the invention positioned in a guitar cabinet slot with the raising lever in contact with the soundboard side of the guitar cabinet slot.

Referring to FIG. 2, reference numeral 25 generally designates the pitch-changing device embodying features of the present invention. Tension control lever 24 is rotatively mounted on a bridge pin 26. A raising lever 36 is also rotatively mounted on bridge pin 26 and immediately adjacent to tension control lever 24. At the bottom of raising lever 36 is a raising flange 37 for selectable attachment of a pull rod 66. Pull rod 66 actuates raising lever 36 from a neutral position, shown in FIG. 3 to an actuated position, shown in FIG. 4. A fixed nut 65 and balance spring 59 are adjustably secured to pull rod 66 which, when activated, causes the fixed nut 65 and balance spring 59 to engage the raising flange 37. By pre-adjusting threaded fixed nut 65 the distance raising lever 36 travels when actuated through the foot or knee pedal is adjusted until the raising lever 36 is in firm contact with the guitar cabinet slot 48 as shown in FIG. 4. Balance spring 59 allows for slight over adjustment of the fixed nut 65 to ensure that raising lever 36 is in firm contact with guitar cabinet slot 48. A lowering lever 34 is pivotally mounted to raising lever 36 by a pivot rivet 42. On the top portion of, and integral to lowering lever 34, is a cam 39 for engaging and causing tensional rotation of tension control lever 24 when raising lever 36 is actuated.

Figure 3:
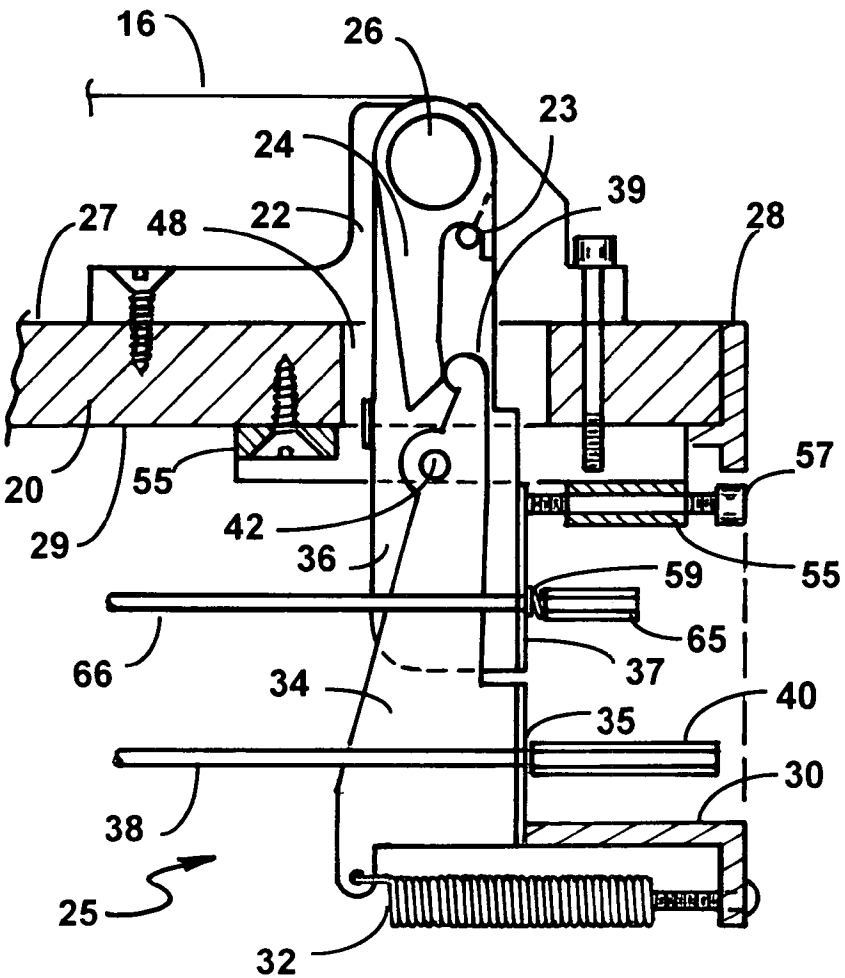
FIG. 3 is a side view of the pitch-changing device in the neutral position in accordance with an embodiment of the invention positioned in a guitar cabinet slot with the raising lever in contact with the tone ring neutral stop bar adjustment screw.
Figure 5:
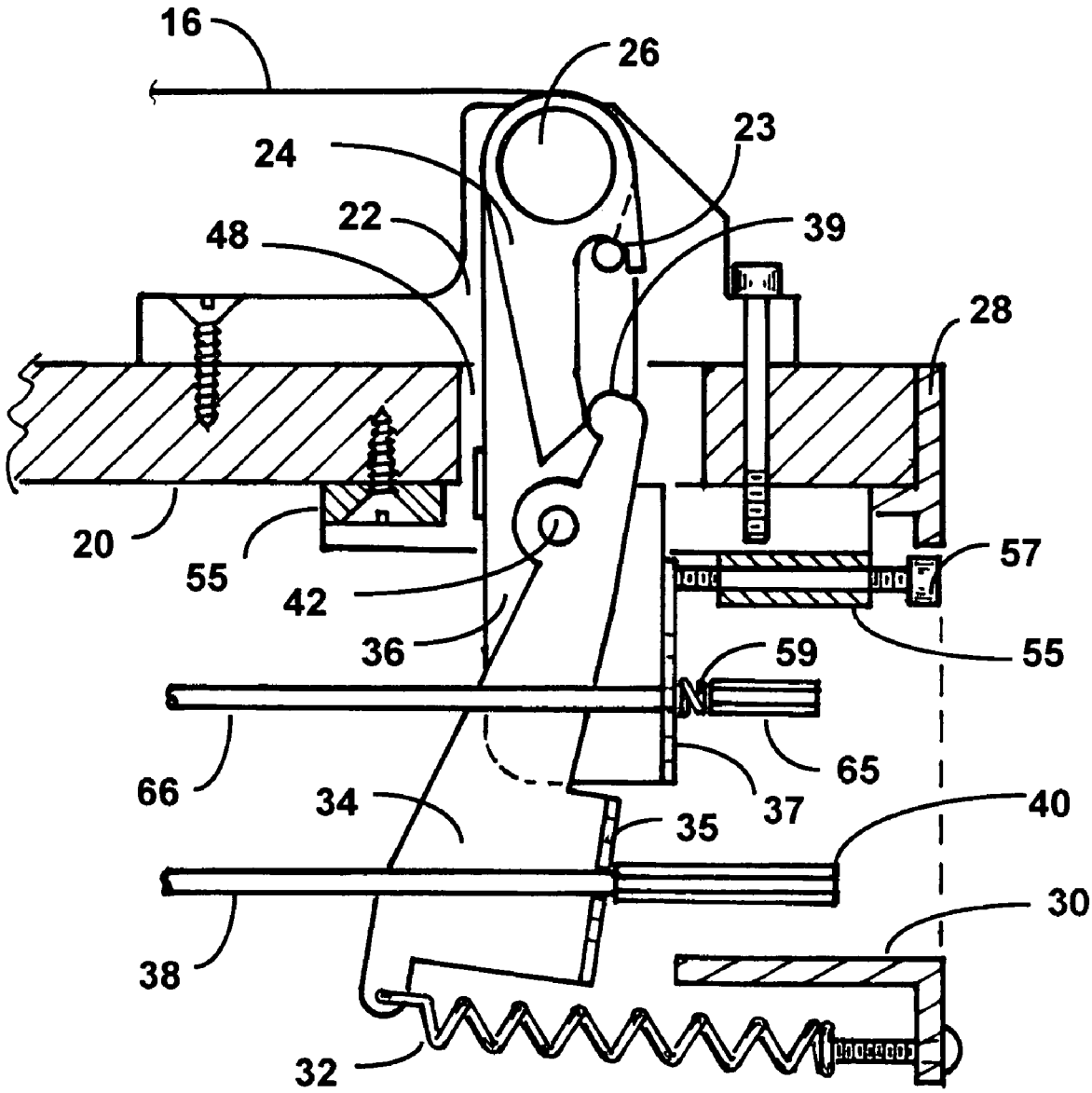
FIG. 5 is a side view of the pitch-changing device in the lowered position in accordance with an embodiment of the invention positioned in a guitar cabinet slot with the raising lever in contact with the tone ring neutral stop bar adjustment screw.

Continuing the description of the preferred illustrated embodiment, on the lower portion of lowering lever 34 is a lowering flange 35 for selectable attachment of a pull rod 38. Pull rod 38 actuates lowering lever 34 from a neutral position, as shown in FIG. 3, to an actuated position, as shown in FIG. 5. A tuning nut 40 is adjustably secured to pull rod 38 which, when activated, causes tuning nut 40 to engage lowering flange 35. In the preferred embodiment, when the lowering lever 34 is actuated to the lowered pitch position, the raising lever 36 remains in direct contact with the neutral stop adjustment screw 57 incorporated in the tone ring 55, thus imparting the string energy of the lowered pitch directly into the guitar cabinet soundboard 20. A plurality of pull rod actuating means 45 (not shown, but well known in the art) are attached to the opposite end of each pull rod 66 or 38 for selective actuation of raising lever 36 or lowering lever 34 attached to pull rod 66 or 38 by the musician. Such actuating means may be of the type such as a foot or knee pedal well known in the art.

Referring to FIG. 3, guitar cabinet soundboard 20 having an upper surface 27 and lower surface 29 is shown with raising lever 36 and lowering lever 34 both in a neutral or non-actuated position. Guitar cabinet soundboard 20 has a cabinet slot 48 through which tension control lever 24 is downwardly suspended from bridge pin 26. Bridge pin 26 is mounted to a changer mounting bracket 22 which is rigidly attached to the guitar cabinet soundboard upper surface 27. A tone ring 55 which encircles the pitch-changing device 25 is rigidly attached to the guitar cabinet soundboard lower surface 29. Tone ring 55 incorporates a neutral stop bar adjustment screw 57 which remains in rigid contact with raising lever 36 in the neutral or non-actuated position. A return spring 32 is attached at one end to the bottom of lowering lever 34. Return spring 32 is adjustably attached at its opposite end to a stop plate 30. Return spring 32 may alternatively be attached to an end plate 28 or to another rigid fixture which is in turn, rigidly attached to guitar cabinet 20 or end plate 28.

Referring to FIG. 4, guitar cabinet soundboard 20 is shown with raising lever 36 in the actuated position and lowering lever 34 in the non-actuated position. In this position, cam 39 generates tensional increasing rotation of tension control lever 24 until raising lever 36 stops in firm contact with cabinet slot 48.

Referring to FIG. 5, guitar cabinet soundboard 20 is shown with raising lever 36 in the non-actuated position and lowering lever 34 in the actuated position. In this position, cam 39 generates tensional decreasing rotation of tension control lever 24 while raising lever 36 remains in rigid contact with tone ring neutral stop adjustment screw 57.

Figure 6:
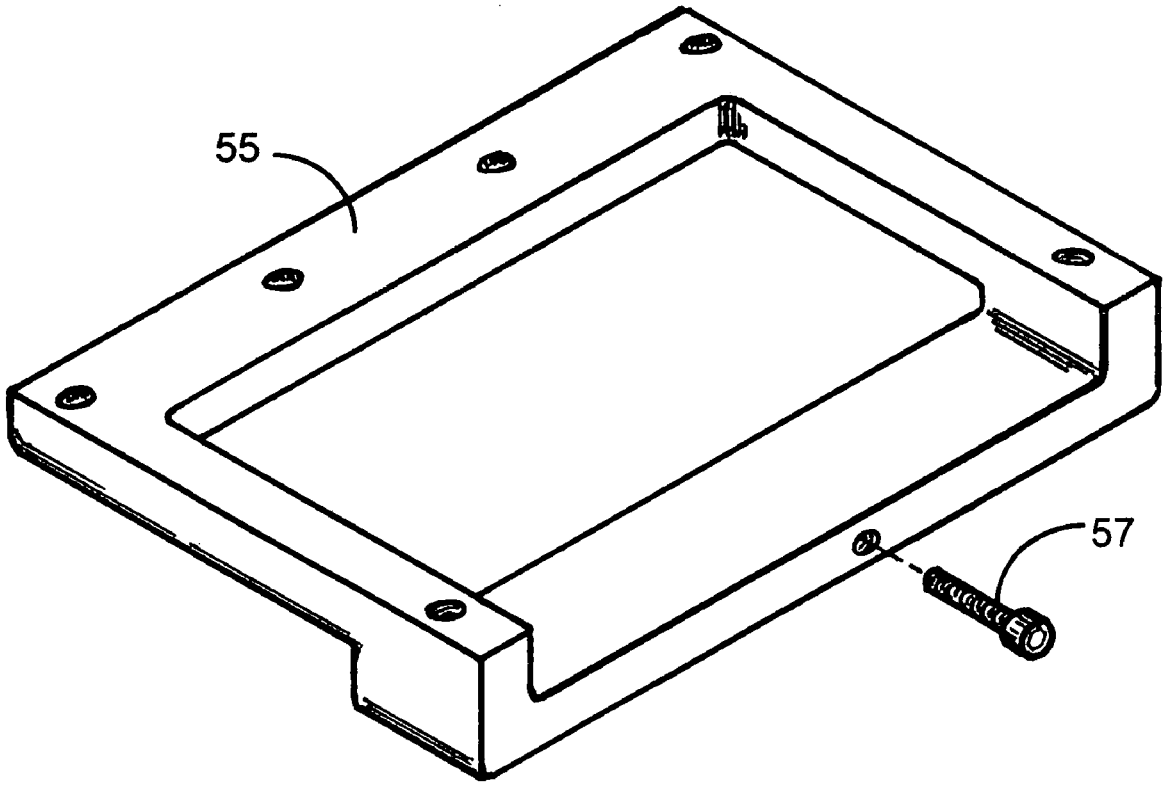
FIG. 6 is an isometric drawing of the aforementioned tone ring shown in isolation for clarity.

Referring to FIG. 6, the aforementioned tone ring 55 structure in accordance with the invention is shown in perspective and also in isolation, along with an example of one neutral stop adjustment screw 57.

OPERATION

Each of strings 16 on pedal steel guitar 50 are attached on one end to a tuning key 17. Tuning key 17 provides tensional adjustment of strings 16 to bring them into raised tuning pitch when the raising lever 36 is pulled tightly into contact with the guitar cabinet slot 48. The opposite end of strings 16 are attached by string attachment means 23 to tension control lever 24. Open-pitch tuning of a string 16 occurs when raising lever 36 and lowering lever 34 are both in the neutral, non-actuated position as shown in FIG. 3. In the neutral position, raising lever 36 is not actuated, and is in substantially full contact with the neutral stop bar tuning screw 57 incorporated in the tone ring 55, thus imparting the string harmonics directly into guitar cabinet soundboard 20 when string 16 is played. In the neutral position, lowering lever 34 is not actuated and remains anchored by return spring 32 to the stop plate 30.

When the musician desires to increase the pitch of a string 16, the proper pull rod actuating means, not shown but well known in the art, is manually activated by selecting and actuating an associated foot pedal or knee lever. When actuated, pull rod 66 then causes threaded fixed nut 65 and balance spring 59 to engage raising flange 37. When actuated, pull rod 66 causes actuation by rotation of raising lever 36 about bridge pin 26 until raising lever 36 comes into firm contact with guitar cabinet slot 48 as shown in FIG. 4. Pivot means 42 attachment of raising lever 36 to lowering lever 34 causes a coincidental counter-rotation of lowering lever 34. During this rotation, lowering lever 34 remains held against stop plate 30 by return spring 32, whereby stop plate 30 provides fulcrum load bearing of lowering lever 34. As lowering lever 34 is counter-rotated, cam 39 engages tension control lever 24, causing tensional increasing rotation of tension control lever 24. This rotation increases the tension of string 16, thus achieving the desired increased pitch.

When the musician desires to decrease the pitch of a string 16, he manually activates the proper pull rod actuating means, not shown but well known in the art. When actuated, pull rod 38 then causes threaded tuning nut 40 to engage lowering flange 35. When actuated, pull rod 38 causes actuation by rotation of lowering lever 34 about pivot means 42. In this rotation, lowering lever 34 departs from contact with stop plate 30 and return spring 32 is expanded as shown in FIG. 5. Raising lever 36 remains in the non-actuated position, and in direct contact with the tone ring neutral stop bar tuning screw 57. As lowering lever 34 is rotated, cam 39 engages tension control lever 24, causing tensional decreasing rotation of tension control lever 24. This rotation decreases the tension of string 16, thus achieving the desired decreased pitch.

Although the preferred illustrated embodiment includes a tension control lever, raising lever, and lowering lever, other embodiments are possible. For example, a single lever may be connected directly to the tension control lever by pivotal support, such as a rivet. This single lever can be made to have both raising and lowering flanges. Another possible alternate embodiment may have both separate raising and lowering levers connected by pivot means to each other. In this alternate embodiment, the raising finger is connected to the tension control lever by a pivot connection such as in U.S. Pat. No. 4,080,864 herein incorporated by reference.

In yet another embodiment of the present invention, the tension control lever, when rotated clockwise by actuation of the raising lever as described herein, would stop against the guitar cabinet slot in the raised pitch position, thus imparting the string energy into the guitar cabinet soundboard. In any embodiment, however, the raising finger or the tension control lever stops against the cabinet guitar slot in the raised positions in similar fashion to the preferred embodiment described herein.

In yet another embodiment of the present invention, the tone ring neutral stop bar would be fixed, i.e., non adjustable, so as to be used with any pitch-changing device as described by prior art.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

I claim:

1. A pitch changing mechanism for a pedal steel guitar having a cabinet including a soundboard, said pitch changing mechanism comprising:

a) a tension control lever pivotally connected to a control bridge pin with a string attachment means;

b) a lowering pitch-changing lever with a plurality of rod attachment means;

c) a pivot means for pivotally attaching the lowering lever to a raising lever;

d) a raising pitch-changing lever with a plurality of rod attachment means, pivotally attached to the lowering lever and pivotally connected to the control bridge pin; the raising lever being selectively attachable to a pull rod to actuate the raising lever from a neutral position to an actuated position, and includes a portion that stops in contact with a cabinet slot portion of the steel guitar cabinet soundboard when the raising lever is in the actuated position;

e) respective pull rods attached to said raising lever and said lowering lever, so that on pulling of each respective pull rod, said corresponding raising and lowering levers create clockwise or counterclockwise rotation of tension control lever about the bridge pin, thus raising or lowering the tension of the string trained across said tension control lever to raise or lower the pitch;

f) a biasing spring attached to the lowering lever; and g) a tone ring which is mounted in direct contact with said guitar cabinet soundboard and encircles said pitch-changing mechanism and which incorporates a neutral position stop bar.

2. A pitch changing mechanism as defined in claim 1 in which said neutral position stop bar includes a neutral position adjustment screw.

3. A pitch-changing mechanism as defined in claim 1, in which said raising lever is constructed so as to stop in the actuated position against the soundboard side of said guitar cabinet slot.

4. A pitch-changing mechanism, as defined in claim 2 in which the raising lever stops in the neutral position in direct contact with the tone ring neutral stop bar adjustment screw.

5. An all-pull pedal steel guitar comprising:

a) a guitar cabinet, having a soundboard with an upper surface and an opposite lower surface, and having a cabinet slot opening at one end between the upper surface and the lower surface;

b) a pair of support brackets containing a bridge pin mounted to the upper surface of the guitar cabinet, and located about the cabinet slot;

c) a plurality of tension control levers pivotally connected to the bridge pin, the control levers each having a respective string attachment means;

d) a fretboard attached to the upper surface of the guitar cabinet;

e) a plurality of strings mounted across the fretboard, each of the strings secured at one end to a keyhead with adjustable tension means, each of the strings secured at its opposite end to a respective one of the tension control levers;

f) a plurality of raising levers extending through the cabinet slot opening, each of the raising levers pivotally connected to the bridge pin, each of the raising levers being positioned adjacent to a respective one of the tension control fryer levers, each raising lever being moveable between a neutral position and an actuated position and constructed so as to stop in immediate contact with a portion of the snowboard adjacent the cabinet slot opening when the raising lever is in the actuated position;

g) a plurality of raising pull rods, each raising pull rod being attached to a respective one of the raising levers for moving the respective raising lever from the neutral position to the actuated position; each raising pull rod including an adjustable fixed nut and a balance spring positioned between the adjustable fixed nut and the respective raising lever to insure firm contact of the respective raising lever with the guitar cabinet soundboard in the actuated position;

h) a plurality of lowering levers, each of the lowering levers pivotally attached to a respective one of the raising levers and having an end portion in contact with the respective tension control lever i) a plurality of lowering pull rods, each said lowering pull rod being attached to a respective one of the lowering levers for moving the respective lowering lever from a neutral position to an actuated position; and j) a plurality of pull rod actuating means for selective movement of pull rods.

6. The all-pull pedal steel guitar as in claim 5 and wherein each of the raising levers is positioned against a neutral stop bar in the neutral position, the neutral stop bar being mounted on the cabinet adjacent to the cabinet slot opening.

7. The all-pull pedal steel guitar as in claim 6 wherein the neutral stop bar includes a plurality of neutral position adjustment screws, a portion of each raising lever contacting a respective one of the neutral position adjustment screws in the neutral position.

8. The all-pull pedal steel guitar as in claim 6 wherein the neutral stop bar forms part of a tone ring mounted on the soundboard and encircling the cabinet slot opening.

9. The all-pull pedal steel guitar as in claim 6 and wherein each of the lowering levers is positioned against a stop plate in the neutral position and the stop plate is in generally vertical alignment with the neutral stop bar and is oriented generally perpendicular to the lowering levers when the lowering levers are in the neutral position.

10. The all-pull pedal steel guitar as in claim 5 and further including a plurality of return spring means for biasing each of the lowering levers against the stop plate when an adjacent raising lever is actuated, the return spring means biasing each of the lowering levers against the stop plate when the raising lever and an adjacent lowering lever are in the neutral position, the return spring means urging each of the lowering levers to the neutral position against the stop plate when released from the actuated position.

11. The all-pull pedal steel guitar as in claim 5 wherein the upper end of each said lowering lever includes an integral cam, the cam engaging the control lever for selective rotational positioning of the control lever, the cam generating tensional reducing rotation of the control lever when the lowering lever is actuated, the cam generating tensional increasing rotation of the control lever when the raising lever is actuated.

12. In a pedal steel guitar having a soundboard with a slot formed therethrough, a pitch changing mechanism comprising:

a) a control bridge pin positioned above the slot;

b) a tension control lever pivotally connected to said control bridge pin and including string attachment means;

c) a raising lever pivotally connected to said control bridge pin adjacent to said tension control lever and extending through the slot in the soundboard;

d) a lowering lever pivotally connected to said raising lever and having an upper end in contact with said tension control lever; and e) a neutral stop mounted on said soundboard adjacent a rear edge of the slot and including a neutral position adjustment screw; wherein f) in a neutral position of said pitch changing mechanism, a first portion of said raising lever is in contact with said neutral position adjustment screw.

13. The pitch changing mechanism as in claim 12 wherein said neutral stop comprises a portion of a tone ring mounted on said soundboard and encircling said slot in said soundboard.

14. The pitch changing mechanism as in claim 12 wherein said raising lever is movable from said neutral position into an actuated position wherein a second portion of said raising lever is in contact with the soundboard at an edge of the slot.

15. The pitch changing mechanism as in claim 14 and further including a pull rod connected to said raising lever and operable to move said raising lever from said neutral position into said actuated position, said pull rod including an adjusting nut and a balance spring positioned between said adjusting nut and a portion of said raising lever to insure firm contact between said raising lever and the soundboard in the actuated position.

16. The pitch changing mechanism as in claim 13 and further including a neutral stop mounted on said soundboard adjacent a rear edge of said slot and including a neutral position adjustment screw; wherein a second portion of said raising lever is in contact with said neutral position adjustment screw in said neutral position.

17. The pitch changing mechanism as in claim 14 wherein said neutral stop comprises a portion of a tone ring mounted on said soundboard and encircling said slot in said soundboard.

18. In a pedal steel guitar having a soundboard with a slot formed therethrough, a pitch changing mechanism comprising:

a) a control bridge pin positioned above said slot;

b) a tension control lever pivotally connected to said control bridge pin and including string attachment means;

c) a raising lever pivotally connected to said control bridge pin adjacent to said tension control lever and extending through said slot in said soundboard;

d) a lowering lever pivotally connected to said raising lever and having an upper end in contact with said tension control lever; and e) a neutral stop mounted on said soundboard adjacent a rear edge of said slot and including a neutral position adjustment screw; wherein f) said raising lever is moveable between a neutral position wherein a first portion of said raising lever is in contact with said neutral position adjustment screw and a actuated position wherein a second portion of said raising lever is in contact with a portion of said soundboard proximate a forward edge of said slot.

19. The pitch changing mechanism as in claim 18 and further including a pull rod connected to said raising lever and operable to move said raising lever from said neutral position into said actuated position, said pull rod including an adjusting nut and a balance spring positioned between said adjusting nut and a portion of said raising lever to insure firm contact between said raising lever and the soundboard in the actuated position.

20. The pitch changing mechanism as in claim 18 wherein said neutral stop comprises a portion of a tone ring mounted on said soundboard and encircling said slot in said soundboard.

21. In a pedal steel guitar having a soundboard with a slot formed therethrough, a pitch changing mechanism comprising:

a) a control bridge pin positioned above said slot;

b) a tension control lever pivotally connected to said control bridge pin and including string attachment means;

c) a raising lever pivotally connected to said control bridge pin adjacent to said tension control lever and extending through the slot in the soundboard;

d) a lowering lever pivotally connected to said raising lever and having an upper end in contact with said tension control lever; and e) a pull rod connected to said raising lever for moving said raising lever between a neutral position and an actuated position wherein a first portion of said raising lever is in contact with a portion of the soundboard proximate a first edge of the slot, said pull rod including an adjusting nut and a balance spring positioned between said adjusting nut and a portion of said raising lever to insure firm contact between said raising lever and the soundboard in the actuated position.

* * * * *